US012291863B2

(12) United States Patent
Nelson

(10) Patent No.: US 12,291,863 B2
(45) Date of Patent: May 6, 2025

(54) STRUCTURALLY REINFORCED GIRTS AND RELATED SYSTEMS AND METHODS

(71) Applicant: Knight Wall Systems, Deer Park, WA (US)

(72) Inventor: Brian Nelson, Spokane, WA (US)

( * ) Notice: Subject to any disclaimer, the term of this patent is extended or adjusted under 35 U.S.C. 154(b) by 199 days.

(21) Appl. No.: 17/793,711

(22) PCT Filed: Feb. 18, 2021

(86) PCT No.: PCT/US2021/018565
§ 371 (c)(1),
(2) Date: Jul. 19, 2022

(87) PCT Pub. No.: WO2021/168104
PCT Pub. Date: Aug. 26, 2021

(65) Prior Publication Data

US 2023/0049477 A1 Feb. 16, 2023

Related U.S. Application Data

(60) Provisional application No. 62/977,861, filed on Feb. 18, 2020.

(51) Int. Cl.

| | |
|---|---|
| ***E04B 2/60*** | (2006.01) |
| ***E04F 13/08*** | (2006.01) |
| *E04B 2/02* | (2006.01) |

(52) U.S. Cl.
CPC ..... *E04B 2/60* (2013.01); *E04F 13/0803* (2013.01); *E04B 2002/0282* (2013.01)

(58) Field of Classification Search
CPC ..... E04B 2/60; E04F 13/0803
See application file for complete search history.

(56) References Cited

U.S. PATENT DOCUMENTS

| | | | | |
|---|---|---|---|---|
| 4,637,190 | A * | 1/1987 | Minialoff | E04C 2/292 52/579 |
| 5,239,791 | A * | 8/1993 | Mills, Jr. | E04D 3/405 52/60 |
| 6,550,213 | B1 * | 4/2003 | Butler | E02D 27/02 249/34 |

(Continued)

FOREIGN PATENT DOCUMENTS

| | | |
|---|---|---|
| EP | 2565345 A1 | 3/2013 |
| GB | 2505980 B | 7/2017 |

(Continued)

OTHER PUBLICATIONS

Requisition by the Examiner, CA 3168886, mailed Oct. 13, 2023, 4 pgs.

*Primary Examiner* — Joshua K Ihezie

(57) ABSTRACT

Girts, systems incorporating girts, and methods of using girts are disclosed. The girts are structurally reinforced by gussets that are formed with material from the girt walls. In some embodiments, the gussets are formed via an efficient metal stamping process. The girts have a high mechanical strength, are easily manufactured, allow for water drainage and air circulation, improve thermal performance, decrease sound transmission, and reduce material, transportation and labor costs relative to traditional girts. In addition, isolators that may be used with the girts reduce thermal conductivity and divert moisture from mounting locations.

18 Claims, 7 Drawing Sheets

(56) References Cited

U.S. PATENT DOCUMENTS 9,187,913 B2 * 11/2015 Sharpe ..... E04F 13/007
9,528,273 B1 * 12/2016 Harkins ..... E04B 7/18
9,580,909 B2 * 2/2017 Hostetler ..... E04D 3/361
10,233,636 B2 * 3/2019 Kennedy ..... E04B 2/96
10,472,831 B1 * 11/2019 Harkins ..... E04D 13/1625
10,612,574 B1 * 4/2020 Foral ..... F16B 5/0692
11,299,891 B1 * 4/2022 Nelson ..... E04F 13/0826
11,371,240 B1 * 6/2022 Foral ..... E04F 13/0812
11,965,326 B2 * 4/2024 Simonsen ..... E04B 2/767
2008/0006002 A1 * 1/2008 Strickland ..... E04C 3/07
29/897
2009/0151286 A1 * 6/2009 Stensrud ..... E04H 5/10
52/404.1
2010/0187391 A1 * 7/2010 Nehls ..... F24S 25/33
52/173.3
2011/0162320 A1 * 7/2011 Bartlett ..... E04B 5/10
52/843
2012/0227342 A1 * 9/2012 McClure ..... E04F 13/081
52/309.4
2013/0152498 A1 * 6/2013 Krause ..... E04B 1/7629
52/235
2013/0186027 A1 * 7/2013 Sharpe ..... E04F 13/007
52/582.1
2013/0291465 A1 * 11/2013 Resso ..... E04F 13/007
52/302.1
2014/0026510 A1 * 1/2014 Kubassek ..... E04B 2/58
52/512
2015/0128518 A1 5/2015 Knight et al.
2016/0237687 A1 * 8/2016 Hostetler ..... E04D 3/361
2017/0159293 A1 * 6/2017 Haley ..... E04F 13/0803
2018/0171621 A1 6/2018 Kuelker
2019/0186120 A1 * 6/2019 Haba ..... E04B 1/388
2021/0254347 A1 * 8/2021 Nelson ..... E04F 13/0862
2022/0186489 A1 * 6/2022 Simonsen ..... E04B 1/61

FOREIGN PATENT DOCUMENTS

KR 200486029 Y1 3/2018
WO 2008122786 A1 10/2008

* cited by examiner

STRUCTURALLY REINFORCED GIRTS AND RELATED SYSTEMS AND METHODS

CROSS-REFERENCE TO RELATED APPLICATIONS

This application is a 371 national stage application of international application No. PCT/US2021/018565, filed Feb. 18, 2021, which claims the benefit of and priority to U.S. Provisional Patent Application No. 62/977,861, filed Feb. 18, 2020, each of which is hereby incorporated by reference in its entirety.

BACKGROUND

The present disclosure generally relates to building materials, such as girts, and related construction methods.

Traditional girts are heavy, welded or forged, steel components that have few, if any, holes. These characteristics are intended to provide the highest possible mechanical strength, but they also limit ease of manufacture, water drainage, air circulation, adaptability, and material, transportation and labor costs. Therefore, improved girt designs would benefit the construction industry.

SUMMARY

The present invention provides girts, systems incorporating girts, and methods of making and using girts. The disclosed girts are structurally reinforced by gussets that are formed with material from the girt walls. In some embodiments, the gussets are formed via a metal stamping process. The girts have a high mechanical strength, are easily manufactured, allow for water drainage and air circulation, improve thermal performance, decrease sound transmission, and reduce material, transportation and labor costs relative to traditional girts. In addition, isolators that may be used with the girts reduce thermal conductivity and divert moisture from mounting locations.

In an aspect, a girt comprises a first wall and a second wall extending substantially perpendicular to the first wall, wherein the girt comprises at least one gusset disposed in a corner formed by the first wall and the second wall, and wherein the gusset is formed by material from the first wall and/or the second wall.

In an embodiment, the corner of a girt may be formed at a first edge of the first wall and a first edge of the second wall, where such edges may be fixedly joined, or a corner(s) may be formed by a first edge of the first wall contacting a surface of the second wall.

In an embodiment, a gusset is formed by material from one or more girt walls, e.g., by indenting portions of the first wall and the second wall. In an embodiment, a gusset comprises a concave surface.

In an embodiment, a gusset is formed of stamped metal.

In an embodiment, a girt disclosed herein may be selected from the group consisting of a Z-girt, a hat channel, an H-channel, a box girt, an I-beam, an L-bracket, a J-bracket, and rails. It will be appreciated that many of these girts comprise more than two walls and a plurality of corners. Girts with 2, 3, 4, 5 or more walls forming 1, 2, 3, 4 or more corners with gussets in at least one corner are within the scope of this disclosure.

In an embodiment, a girt is contiguous and made of a material selected from the group consisting of steel, stainless steel, carbon fiber, aluminum, plastic, fiber reinforced polymer (e.g., fiberglass) and combinations thereof. In an embodiment, a girt comprises a corrugated material, such as rigidized steel or rigidized stainless steel.

In an embodiment, a third wall forms a second corner and at least one additional gusset is disposed in the second corner.

In an embodiment, concave surfaces of a first gusset and a second gusset are oriented in the same direction or in opposite directions. In an embodiment, a first gusset and a second gusset are aligned with one another along the length of the girt. In an embodiment, a first gusset and a second gusset are identical in size and shape or are of unequal length, width and/or height.

In an embodiment, at least one flared punch or unflared drainage hole is provided in a wall of the girt. For example, flared punches or other openings in a horizontal wall may allow water and moisture to escape the system, reduce the amount of material or weight of the girt, improve thermal performance and/or decrease sound transmission through the component. In an embodiment, a wall of a girt comprises a plurality of holes for receiving fasteners.

In an embodiment, a girt disclosed herein comprises an isolator disposed on a surface of one or more walls. For example, an isolator may be disposed between an exterior wall of a structure and a wall of a girt.

In an embodiment, an isolator comprises at least one angular pocket for receiving a tapered head of a fastener. The angular pocket may also allow moisture to drain away from the fastener penetration. In an embodiment, a top of the isolator slopes away from a mounting location, such as an exterior wall of a structure, to divert water away from the mounting location.

In an embodiment, an isolator comprises a retaining arm that participates in securing the isolator to the girt. For example, a wall of a girt may comprise at least one longitudinal rail protruding from a surface of the wall. In an embodiment, a retaining arm of an isolator, contacting a back surface of a wall, wraps over a top edge of the girt wall and releasably mates with a longitudinal rail protruding from a front surface of the girt wall.

In an aspect, a system for cladding an exterior wall of a structure and insulating the structure wall comprises: plural girts fastened to the structure wall in spaced array; thermally insulating material positionally maintained adjacent the structure wall by the plural girts; and exterior cladding for the structure supported by the plural girts; wherein at least one of the plural girts is a girt as described herein.

In an embodiment, the exterior cladding is fastened directly or indirectly to the girts.

In an embodiment, a system for cladding an exterior wall of a structure and insulating the structure wall provides a continuously insulated wall assembly that satisfies the ASHREA 90.1 performance standards for continuous insulation.

In an aspect, a method of using a girt comprises placing a girt described herein with one wall directly or indirectly against the exterior wall of a structure and applying fasteners through holes of the girt wall, and optionally through an isolator disposed between the girt wall and the exterior wall of the structure.

BRIEF DESCRIPTION OF THE DRAWINGS

Illustrative embodiments of the present invention are described in detail below with reference to the attached drawings, wherein.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

A "system" is a combination of components operably connected to produce one or more desired functions.

A "component" is used broadly to refer to an individual part of a system.

The terms "direct and indirect" describe the actions or physical positions of one component relative to another component. For example, a component that "directly" acts upon or touches another component does so without intervention from an intermediary. Contrarily, a component that "indirectly" acts upon or touches another component does so through an intermediary (e.g., a third component).

"Contiguous" refers to materials or layers that are touching or connected throughout in an unbroken sequence.

A "gusset" refers to a piece of material strengthening an angle or corner of a structure.

Girts disclosed herein may be manufactured by techniques including, but not limited to, metal rolling, metal stamping, welding, laser cutting, computer numerical control (CNC) machining, additive manufacturing, injection molding, extruding, casting and combinations thereof.

Exemplary girts can be seen in FIGS. 1-12, which are described hereafter.

Figure 1:
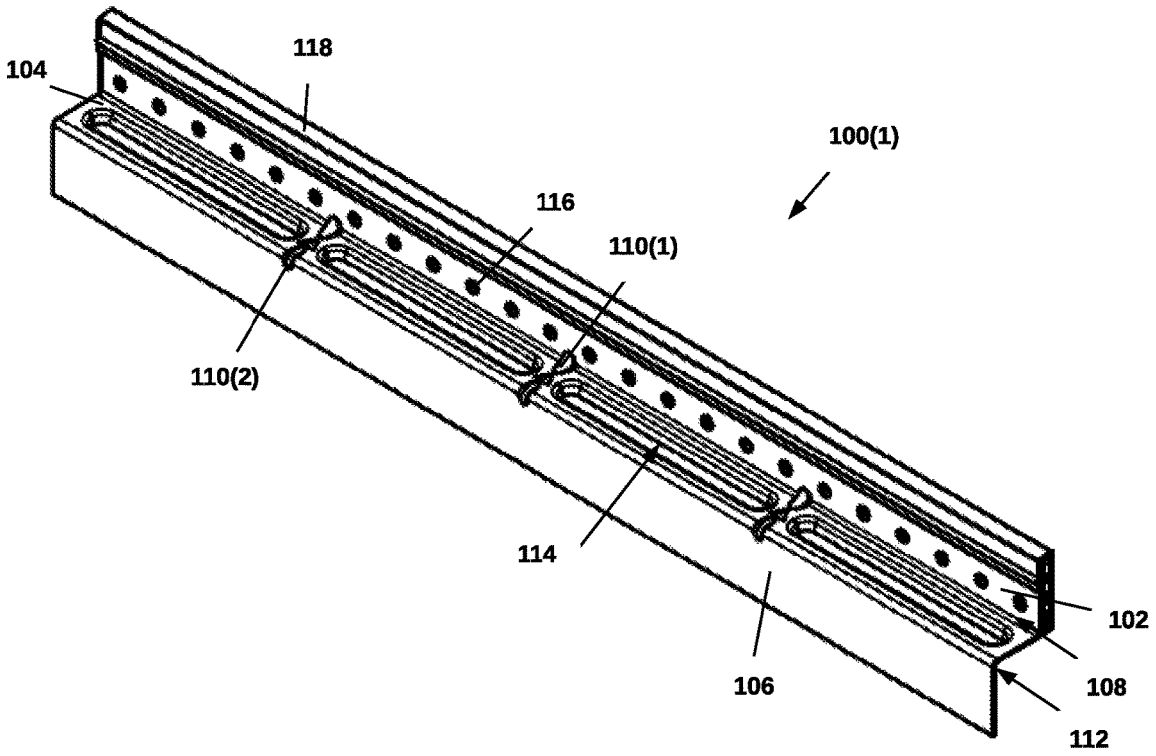
FIG. 1 provides a top perspective view of a girt configured as a Z-girt, according to an embodiment.
Figure 2:
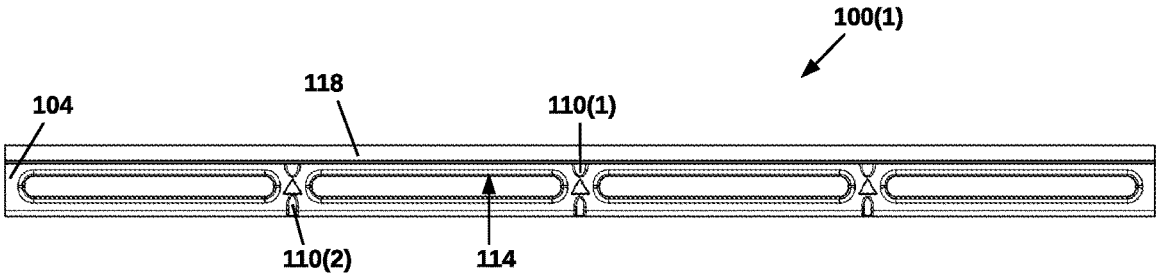
FIG. 2 provides a top plan view of the girt of FIG. 1.
Figure 3:
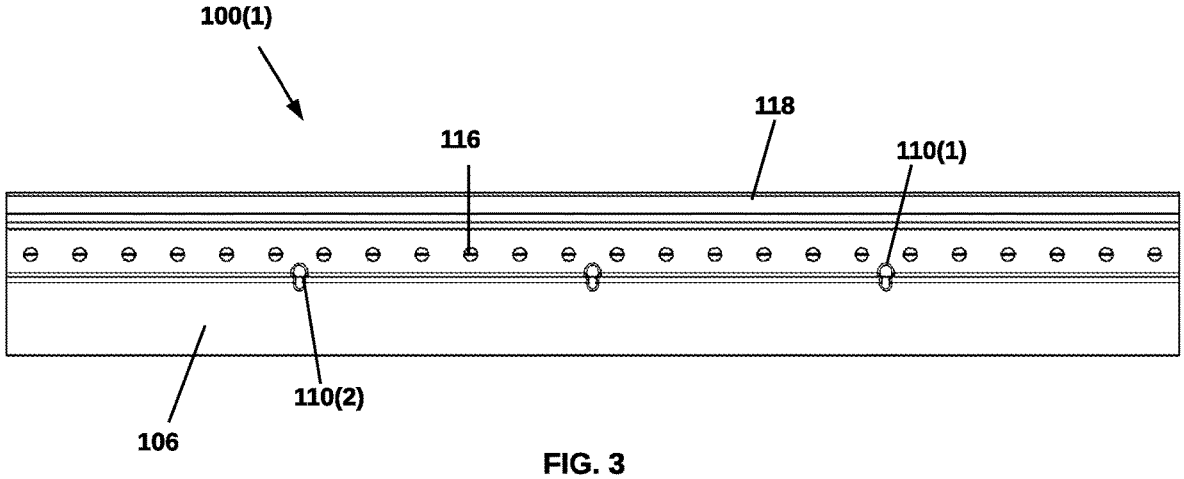
FIG. 3 provides a front plan view of the girt of FIGS. 1-2.
Figure 4:
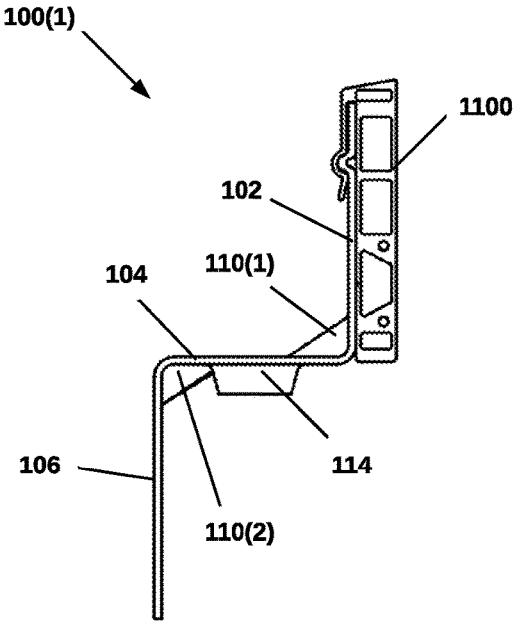
FIG. 4 provides a side plan view of the girt of FIGS. 1-3.
Figure 5:
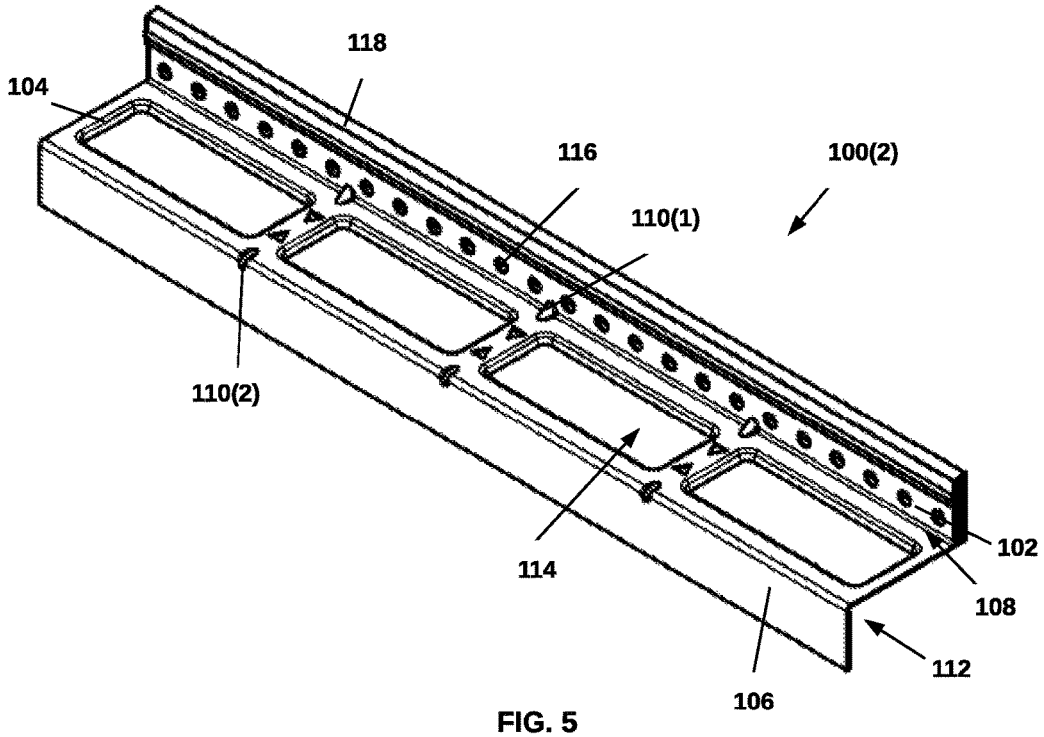
FIG. 5 provides a top perspective view of a girt configured as a Z-girt, according to an embodiment.
Figure 6:
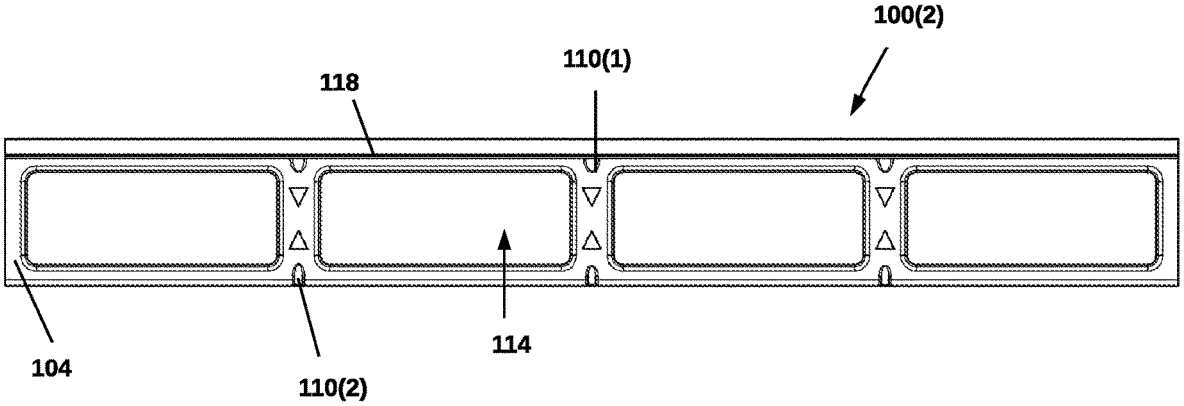
FIG. 6 provides a top plan view of the girt of FIG. 5.
Figure 7:
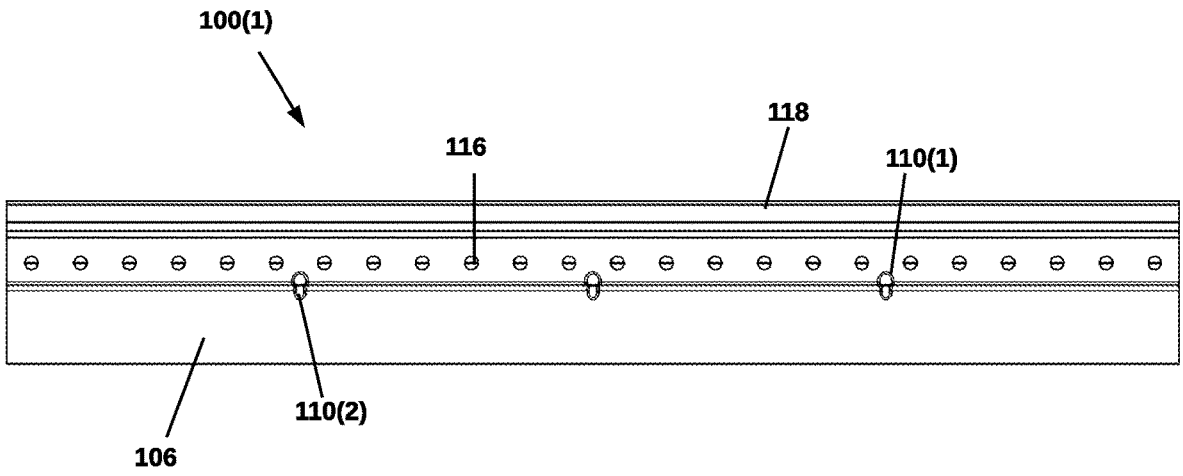
FIG. 7 provides a front plan view of the girt of FIGS. 5-6.
Figure 8:
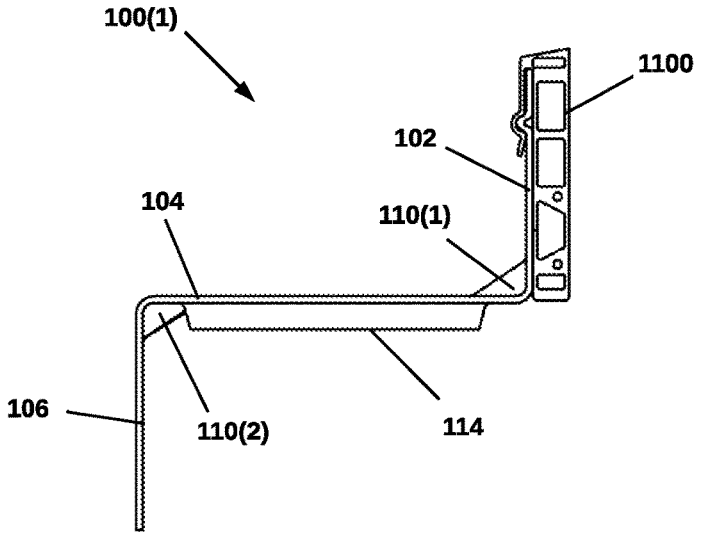
FIG. 8 provides a side plan view of the girt of FIGS. 5-7.
Figure 9:
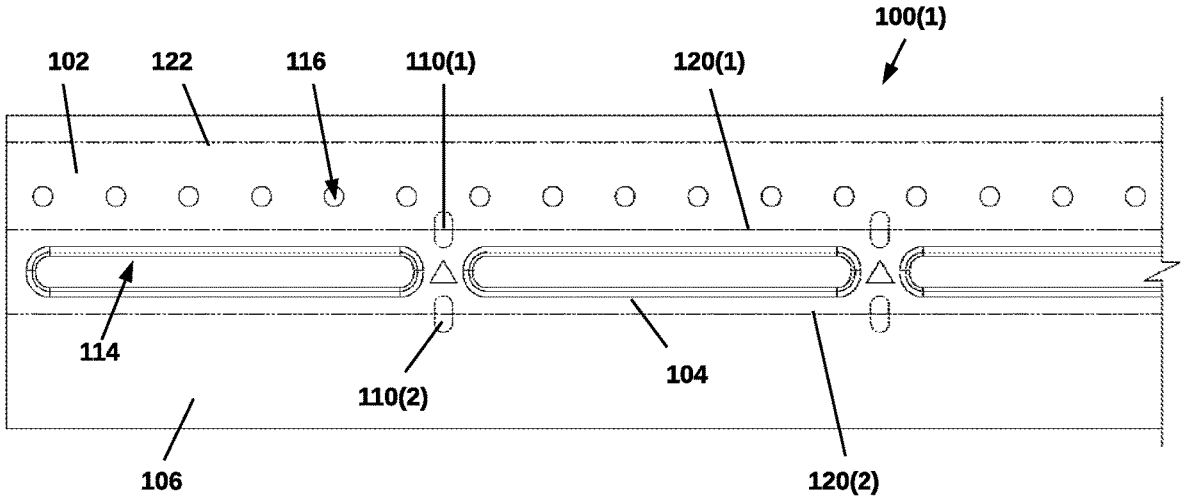
FIG. 9 provides a plan view of the material used to form the girt of FIGS. 1-4 prior to stamping and/or folding of the material.

FIG. 1 provides a front perspective view of a girt 100(1) configured as a Z-girt; FIG. 2 provides a top plan view of girt 100(1); FIG. 3 provides a front plan view of girt 100(1); and FIG. 4 provides a side plan view of girt 100(1). FIG. 5 provides a top perspective view of a girt 100(2) configured as a Z-girt; FIG. 6 provides a top plan view of girt 100(2); FIG. 7 provides a front plan view of girt 100(2); and FIG. 8 provides a side plan view of girt 100(2). FIG. 9 provides a plan view of the material used to form girt 100(1) prior to stamping and/or folding of the material; and FIG. 10 provides a plan view of the material used to form girt 100(2) prior to stamping and/or folding of the material.

With respect to FIGS. 1-4, girt 100(1) comprises a first wall 102, a second wall 104, and a third wall 106 configured as a Z-girt. Second wall 104 extends substantially perpendicular to first wall 102, and the two walls are joined at longitudinal edges to form a corner 108 running the length of the girt. At least one gusset 110(1) is disposed in corner 108. As shown, gusset 110(1) is formed by material from first wall 102 and second wall 104 by a metal stamping process that indents portions of the first and second walls toward an interior of corner 108. In the embodiment shown, gusset 110(1) has a concave surface on its underside. Third wall 106 is joined to an opposing longitudinal edge of second wall 104 to form a second corner 112. As shown, a second gusset 110(2) is disposed in second corner 112. Second gusset 110(2) is formed by material from second wall 104 and third wall 106 by a metal stamping process that indents portions of the second and third walls toward an interior of corner 112 to form a concave surface on an upper surface of gusset 110(2). As shown, opposing gussets are aligned with one another along a length of girt 100(1) and the concave surfaces of the opposing gussets are oriented in opposite directions based on the orientations of the walls and corners. In the embodiment shown, girt 100(1) includes at least one flared punch 114 in second wall 104 such that, when girt 100(1) is used in a horizontal orientation, water and moisture can escape the system, overall mass of the girt is reduced, thermal performance is improved, and sound transmission through the system is decreased. Punches 114 reduce the amount of material needed to produce the girt, thereby decreasing material costs and weight of the final product, which may decrease manufacturing and shipping costs. In addition, first wall 102 also, optionally, includes a plurality of holes 116 for receiving fasteners used to secure the girt to a surface, such as an exterior wall of a structure. Cladding, or other objects, may be secured to third wall 106. In an embodiment, girt 100 is coupled to an isolator 118, which is shown and described in greater detail with reference to FIG. 11.

Girt 100(2) of FIGS. 5-8 contains the same features as girt 100(1). The difference is that girt 100(2) contains a wider second wall 104 than girt 100(1), and wider flared punches 114. Girt 100(2) illustrates that gussets 110 and manufacturing techniques disclosed herein can be used with girts of various sizes and configurations.

Figure 10:
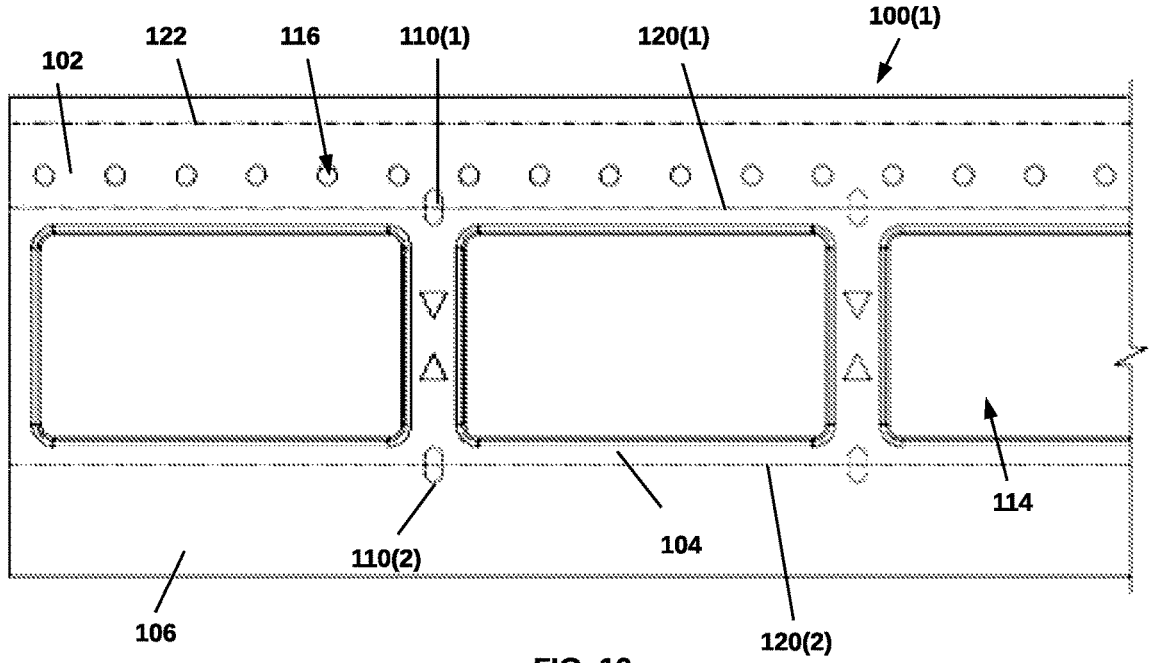
FIG. 10 provides a plan view of the material used to form the girt of FIGS. 5-8 prior to stamping and/or folding of the material.

FIGS. 9 and 10 provide plan views of the material used to form girts 100(1) and 100(2), respectively, prior to stamping and/or folding of the material along fold lines 120(1) and 120(2). The process of stamping metal gussets 110 and a protruding rail 122 from the areas indicated by dashed lines allows girt 100 to be formed efficiently and cost effectively using stamping and folding techniques and foregoing welding, which would typically be required.

Figure 11:
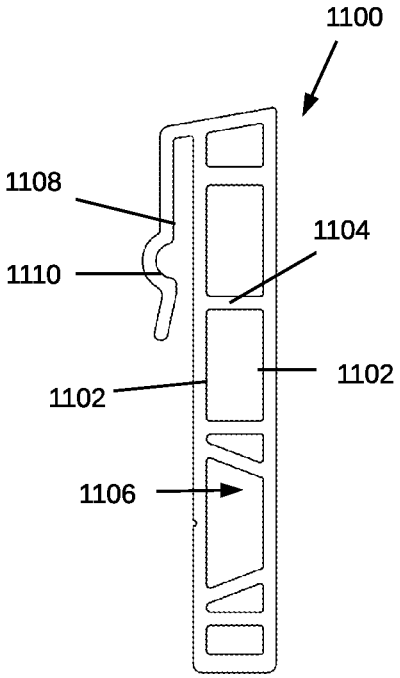
FIG. 11 provides a side plan view of an isolator for coupling with a girt, according to an embodiment.

FIG. 11 provides a side plan view/cross sectional view of an isolator 1100 for coupling with a wall of a girt. Isolator 1100 may be made from any thermally non-conductive material, such as but not limited to plastic, rubber, wood, cardboard, natural fibers, fiber reinforced polymers, and combinations thereof. In the embodiment shown, isolator 1100 comprises two substantially parallel walls 1102 and a plurality of struts 1104 between the walls. As shown, two of the struts 1104 form an angular pocket 1106 for receiving a tapered head of a fastener. A retainer arm 1108 of the isolator 1100 is configured to wrap over an edge of a girt wall or other planar surface. A portion of the retainer arm 1108, positioned substantially parallel to wall 1102, may include a protrusion 1110 for mating with a longitudinal rail on a front surface of a girt wall, thereby helping to secure the isolator to the girt.

Figure 12:
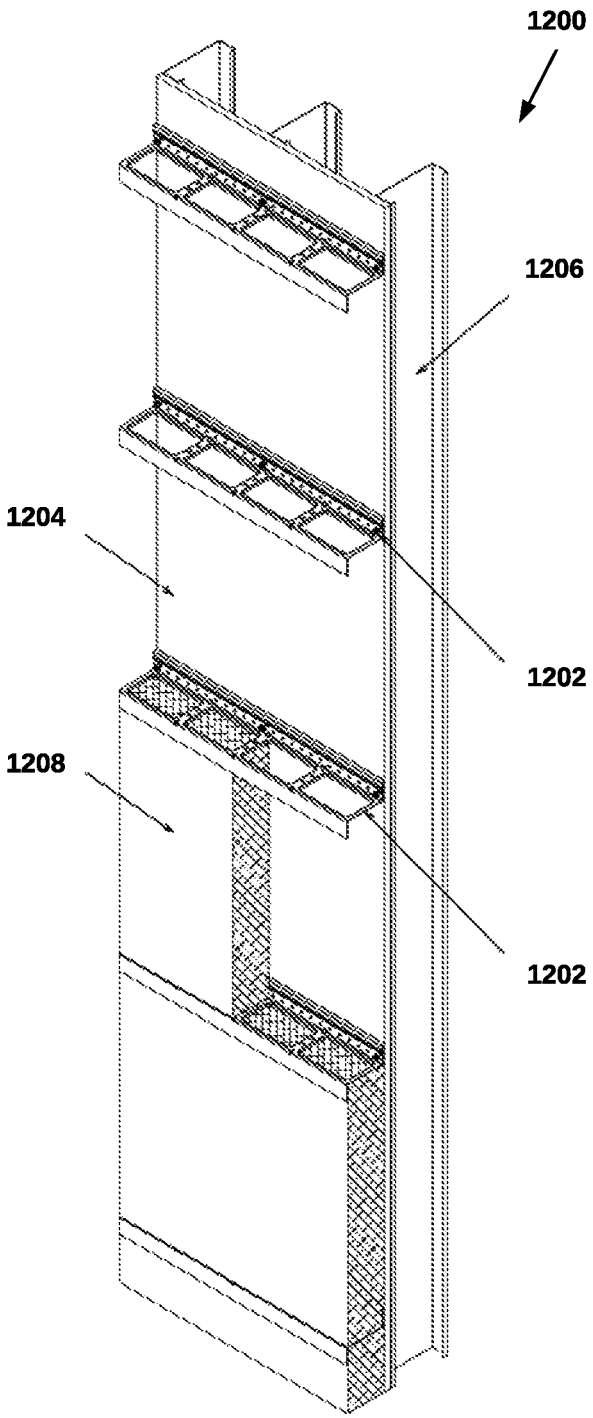
FIG. 12 provides a cutaway view of a system for cladding and insulating an exterior wall of a structure using one or more of the disclosed girts, according to an embodiment.

FIG. 12 provides a cutaway view of a system 1200 for cladding and insulating an exterior wall 1204 of a structure using one or more of the disclosed girts, according to an embodiment. Ordinarily, the exterior wall 1204 of a structure is joined to an inner wall of the structure, such as drywall, through a plurality of studs 1206. System 1200 comprises thermally insulating material 1208 positionally maintained adjacent exterior wall 1204 by plural girts 1202 fastened to studs 1206 or wall 1204 in spaced horizontal array. Exterior cladding for the structure may be supported by the plural girts 1202. In such systems, at least one of the plural girts 1202 may be a girt as described herein.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference.

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a fastener" includes a plurality of such fasteners and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described. Nothing herein is to be construed as an admission that the invention is not entitled to antedate such disclosure by virtue of prior invention.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements or limitation or limitations which is/are not specifically disclosed herein.

All art-known functional equivalents of materials and methods are intended to be included in this disclosure. The terms and expressions that have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments and optional features, modification and variation of the concepts herein disclosed can be resorted to by those skilled in the art, and that such modifications and variations are considered to be within the scope of this invention as defined by the appended claims.

What is claimed is:

1. A girt comprising:

a first wall and a second wall extending substantially perpendicular to the first wall;

the second wall comprising:

a first opening and a second opening;

a bridge spanning between the first opening and the second opening, the bridge beginning at a corner section formed by the first wall and the second wall and terminating at an edge of the second wall;

at least one gusset disposed in at least a portion of the corner section and aligned with the bridge, the at least one gusset comprising:

material from the first wall and/or the second wall; and further comprising a third wall forming a second corner and at least one additional gusset disposed in the second corner, wherein the at least one gusset and the at least one additional gusset are aligned with one another.

2. The girt of claim 1, wherein the corner section is formed at a first edge of the first wall and a first edge of the second wall.

3. The girt of claim 1, wherein the at least one gusset comprises an indentation in portions of the first wall and the second wall.

4. The girt of claim 1, wherein the at least one gusset protrudes toward an interior of the corner section.

5. The girt of claim 1, wherein the at least one gusset comprises a concave surface.

6. The girt of claim 1, wherein the at least one gusset is formed of stamped metal.

7. The girt of claim 1, wherein the girt is selected from the group consisting of a Z-girt, a hat channel, an H-channel, a box girt, an I-beam, an L-bracket, a J-bracket, and rails.

8. The girt of claim 1, wherein the first wall and/or the second wall comprise(s) a corrugated material.

9. The girt of claim 1, wherein the at least one additional gusset comprises an indentation in a portion of the third wall.

10. The girt of claim 1, wherein the at least one additional gusset is formed of stamped metal.

11. The girt of claim 1, wherein the at least one additional gusset comprises a concave surface.

12. The girt of claim 11, wherein concave surfaces of the at least one gusset and the at least one additional gusset are oriented in the same direction or in opposite directions.

13. The girt of claim 1, wherein the first opening is a flared punch.

14. The girt of claim 1 further comprising an isolator disposed on a back surface of the first wall and/or the second wall.

15. The girt of claim 14, wherein the isolator comprises at least one angular pocket.

16. The girt of claim 14, wherein the isolator comprises a retaining arm.

17. The girt of claim 1 further comprising at least one longitudinal rail protruding from a front surface of the first wall.

18. The girt of claim 17 further comprising an isolator contacting a back surface of the first wall, wherein a retaining arm of the isolator wraps over a top edge of the first wall and mates with the at least one longitudinal rail.

* * * * *